US010780483B1

(12) United States Patent
Mears

(10) Patent No.: US 10,780,483 B1
(45) Date of Patent: Sep. 22, 2020

(54) CURVING TOOL FOR WALL AND CEILING FRAMING MEMBERS

(71) Applicant: SIMPSON STRONG-TIE COMPANY INC., Pleasanton, CA (US)

(72) Inventor: Charles Mears, White Bear Lake, MN (US)

(73) Assignee: SIMPSON STRONG-TIE COMPANY INC., Pleasanton, CA (US)

( * ) Notice: Subject to any disclaimer, the term of this patent is extended or adjusted under 35 U.S.C. 154(b) by 644 days.

(21) Appl. No.: 15/489,151

(22) Filed: Apr. 17, 2017

Related U.S. Application Data

(60) Provisional application No. 62/322,829, filed on Apr. 15, 2016.

(51) Int. Cl.

| | |
|---|---|
| ***B21D 11/10*** | (2006.01) |
| ***E04F 21/00*** | (2006.01) |
| ***B21D 5/00*** | (2006.01) |
| *B21D 53/74* | (2006.01) |

(52) U.S. Cl.
CPC ..... *B21D 11/10* (2013.01); *B21D 5/00* (2013.01); *E04F 21/00* (2013.01); *B21D 53/74* (2013.01); *E04F 2203/08* (2013.01)

(58) Field of Classification Search
CPC . B21D 5/00; B21D 5/01; B21D 5/002; B21D 5/16; B21D 49/00; B21D 11/10; E04F 21/00; E04F 2203/08
See application file for complete search history.

(56) References Cited

U.S. PATENT DOCUMENTS

| | | | |
|---|---|---|---|
| 4,875,274 | A | 10/1989 | Foster |
| 5,247,769 | A | 9/1993 | Becker |
| 5,249,445 | A | 10/1993 | Morello |
| 5,359,871 | A | 11/1994 | Morello |
| 5,584,198 | A | 12/1996 | Morello et al. |
| 5,655,282 | A | 8/1997 | Hodek et al. |
| 6,138,359 | A | 10/2000 | Mears |

*Primary Examiner* — Pradeep C Battula
(74) *Attorney, Agent, or Firm* — Buchalter; Cecily Anne O'Regan

(57) ABSTRACT

A tool for shaping wall and ceiling framing members includes a frame and a plate that is adjustable with respect to the fame. A fulcrum is repositionable with the plate to predetermined locations that permit bending of the wall or ceiling framing member about the fulcrum. The member is shaped by placing a first portion of the member at the first end of the frame, placing a second portion of the member at the fulcrum, and bending the member about the fulcrum. To obtain an accurate shaping to the member, the member may be bent about the fulcrum until a third portion contacts a second end of the frame, wherein the fulcrum is between the first and second ends of the frame.

23 Claims, 11 Drawing Sheets

CURVING TOOL FOR WALL AND CEILING FRAMING MEMBERS

CROSS-REFERENCE TO RELATED APPLICATIONS

This application claims priority to U.S. Provisional Patent Application Ser. No. 62/322,829, filed on Apr. 15, 2016 and entitled "CURVING TOOL FOR WALL AND CEILING FRAMING MEMBERS", the content of which being incorporated herein in its entirety.

FIELD OF THE INVENTION

The present invention relates to wall and ceiling framing members for the construction industry, and more particularly to a tool for shaping such wall and ceiling framing members, as well as methods for shaping the wall and ceiling framing members using such tool.

BACKGROUND OF THE INVENTION

Walls and ceilings are often constructed upon a frame that is made up of a plurality of individual framing members which are connected to establish the desired wall or ceiling configuration. Commercial and industrial construction projects typically utilize metal framing members for a variety of reasons. One particular advantage of metal framing members over wood counterparts is the ability to easily shape metal framing members to form non-standard wall and ceiling configurations. In particular, walls and ceilings that exhibit curvature may be most easily constructed with the use of non-linear metal framing members.

Some relatively large scale construction projects obtain the metal framing members in a "pre-curved" configuration, wherein a set of framing members are individually precisely curved by specialized equipment prior to delivery to the construction site. For other projects, however, framing installers are required to establish framing member curvature on-site. While some tools and techniques have been developed in the past to address this need for framing installers to perform rapid shaping of metal framing members on-site, the currently available solutions fail to provide a reliable mechanism for creating accurate curves into wall and ceiling framing members. It is therefore an object of the present invention to provide a tool that is straightforward for use by a framing installer, and is capable of creating consistent and accurate curves to the framing members.

SUMMARY OF THE INVENTION

By means of the present invention, wall and ceiling framing members may be conveniently and accurately shaped with curves or bends, including accurately producing predetermined curvature radii. The members envisioned for use with the present invention include wall or ceiling channels which support the ends of members extending between the channels, as well as such members extending between the channels.

In one embodiment, a tool for shaping wall and ceiling framing members includes a frame having a base and first and second walls connected to the base and defining a length between the first and second walls. The first wall terminates at a first end to define a first height with respect to the base, and the second wall terminates at a second end to define a second height with respect to the base. The tool further includes a plate that is positioned between the first and second walls, and is pivotally secured to the frame about a pivot axis, wherein the plate has a lower surface facing the base, and an opposed upper surface. The tool has an edge movable with the plate and oriented substantially transverse to the first direction within the length. An adjustment member is engaged with the plate, and is arranged to adjust a pivot orientation of the plate about the pivot axis, wherein the edge is positionable upwardly from a first plane connecting the first and second ends of the first and second walls.

In another embodiment, a tool for shaping wall and ceiling framing members includes a housing having a base with a perimeter defining first and second sides, a first wall extending upwardly from the first side and terminating at a first end to define a first height with respect to the base, and a second wall extending upwardly from the second side and terminating at a second end to define a second height with respect to the base. The tool further includes a plate that is connected to the housing, and an adjustment mechanism for selectively adjusting a position of the plate with respect to the base. A fulcrum is repositionable with the plate to a location wherein a first plane connecting the first and second ends of the first and second walls is between the fulcrum and the base.

A method for shaping a wall or ceiling framing member includes providing a tool as described above, and placing a first portion of the wall or ceiling framing member at the first end of the first wall of the tool. A second portion of a wall or ceiling framing member is then placed at the edge of the tool. A wall or ceiling framing member is then bent about the edge of the tool.

DETAILED DESCRIPTION OF THE PREFERRED EMBODIMENTS

Figure 1:
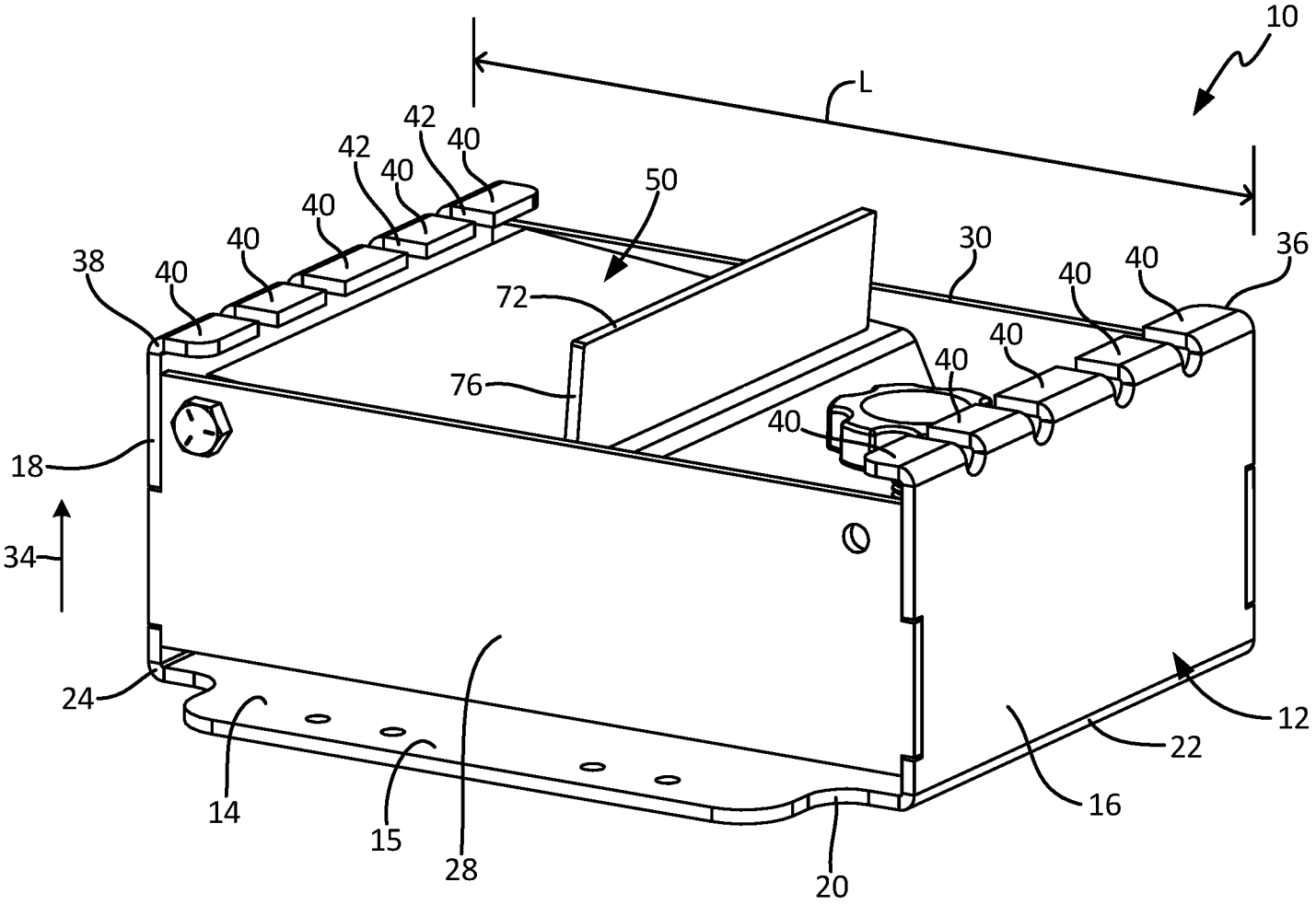
FIG. 1 is a top perspective view of the apparatus of the present invention.
Figure 2:
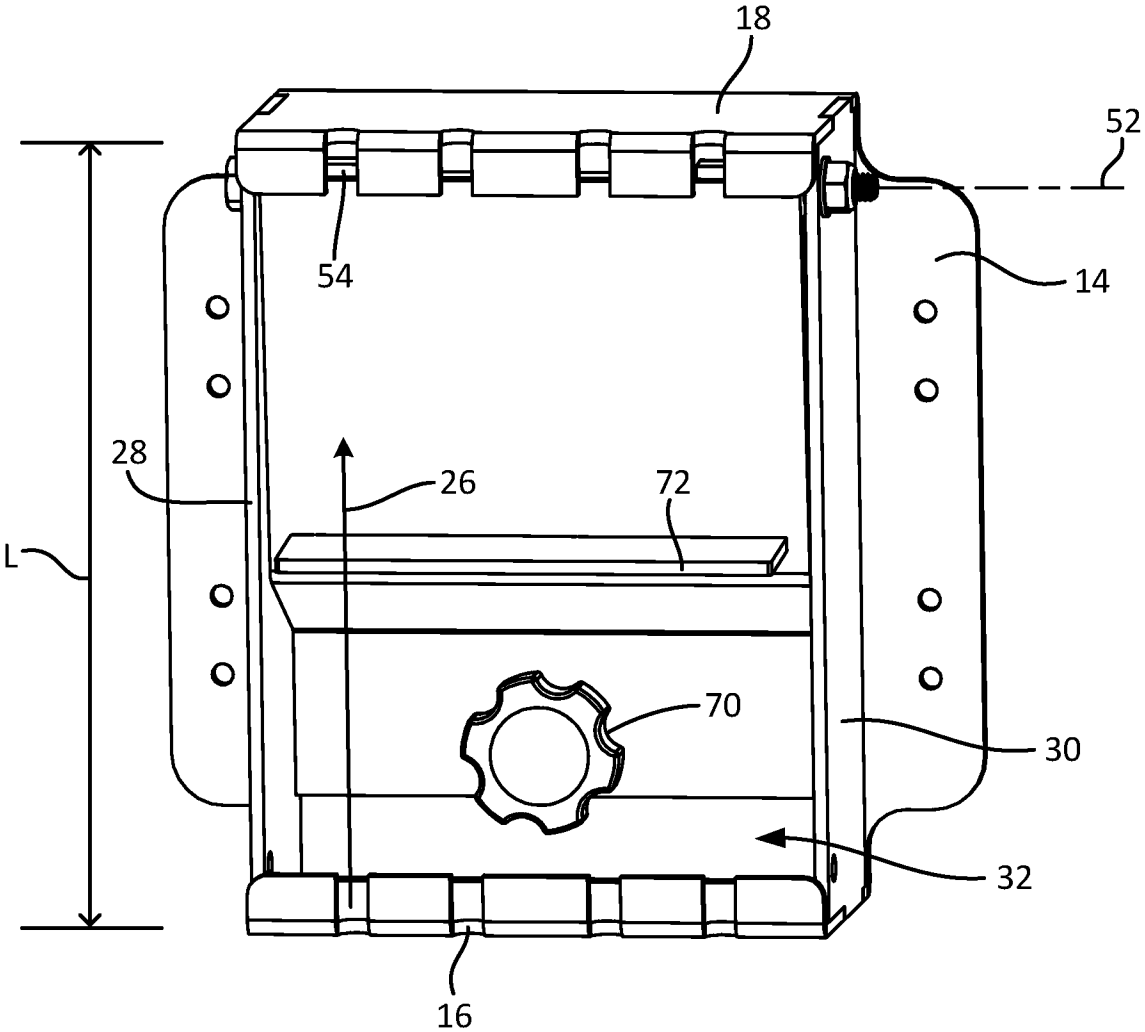
FIG. 2 is a top plan view of the apparatus of the present invention.
Figure 3:
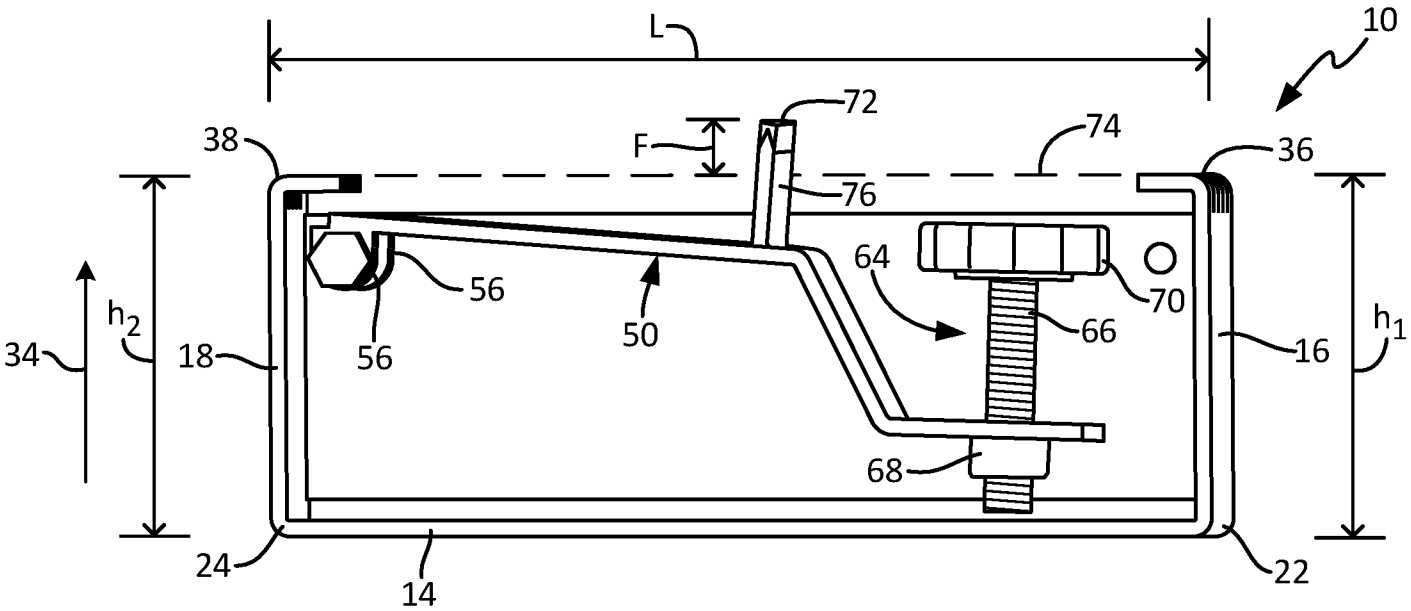
FIG. 3 is a side elevational view of the apparatus of the present invention with a portion removed from view.
Figure 4:
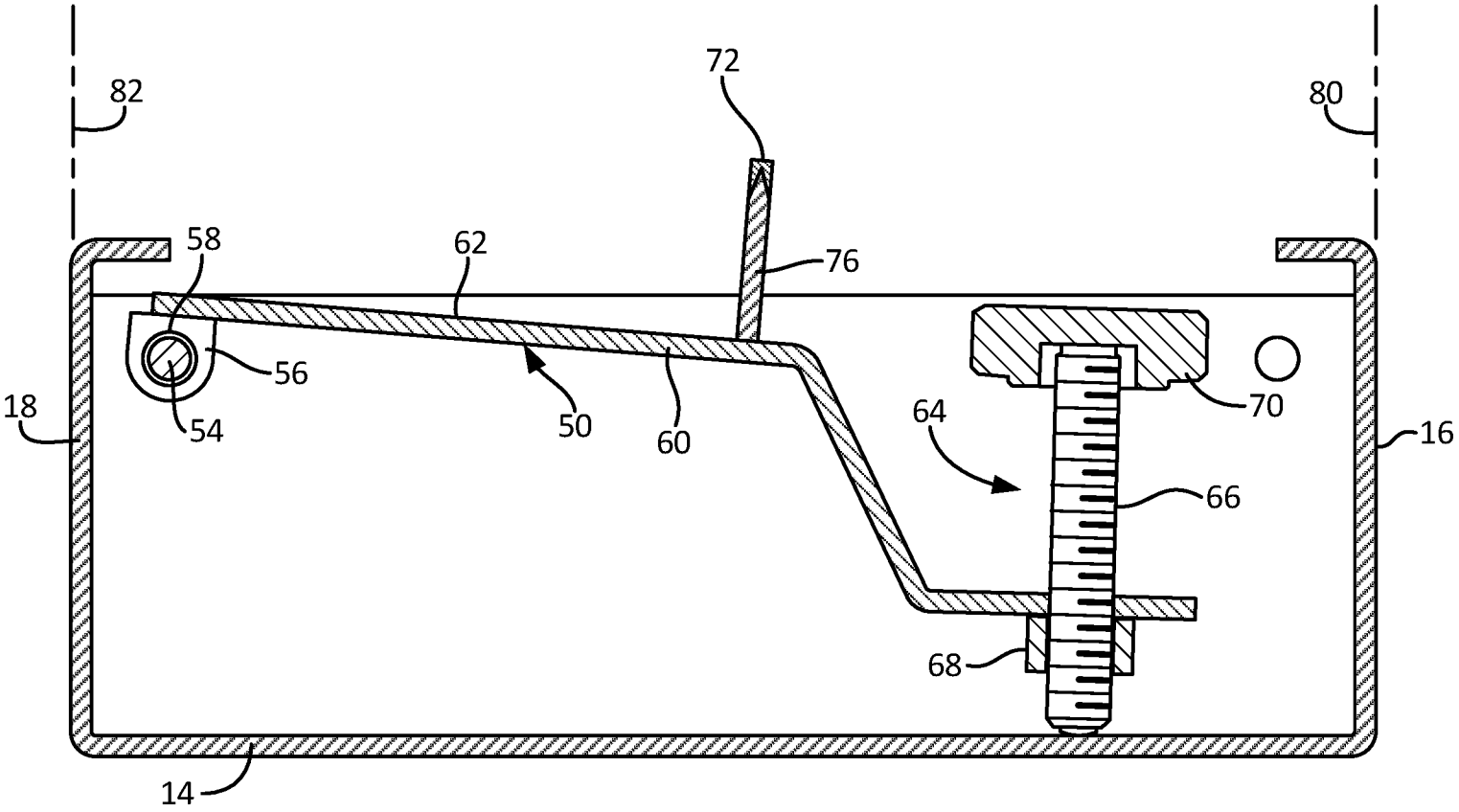
FIG. 4 is a cross-sectional side view of the apparatus of the present invention.
Figure 5:
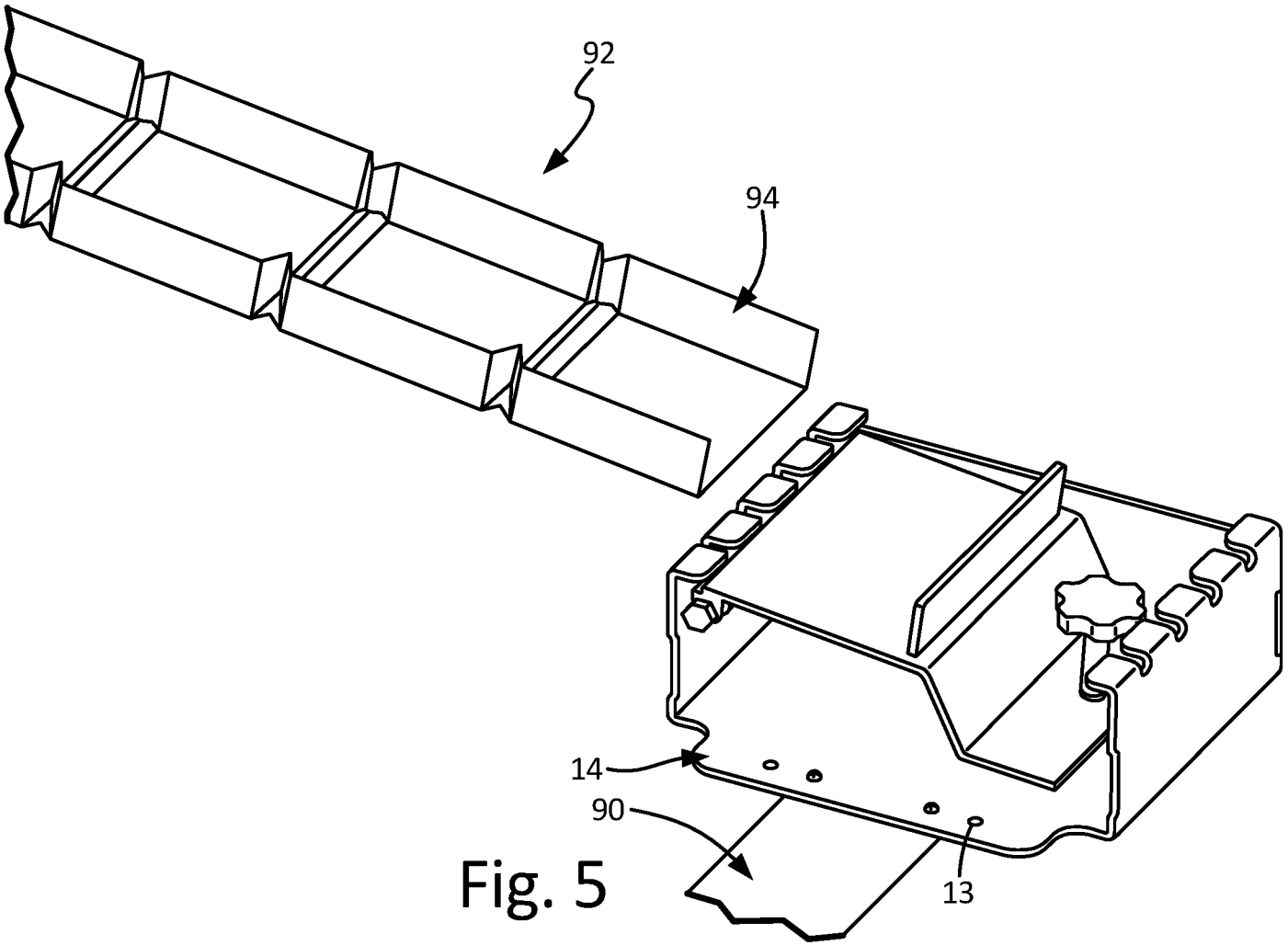
FIG. 5 is a perspective view of the apparatus of the present invention with a workpiece.
Figure 6:
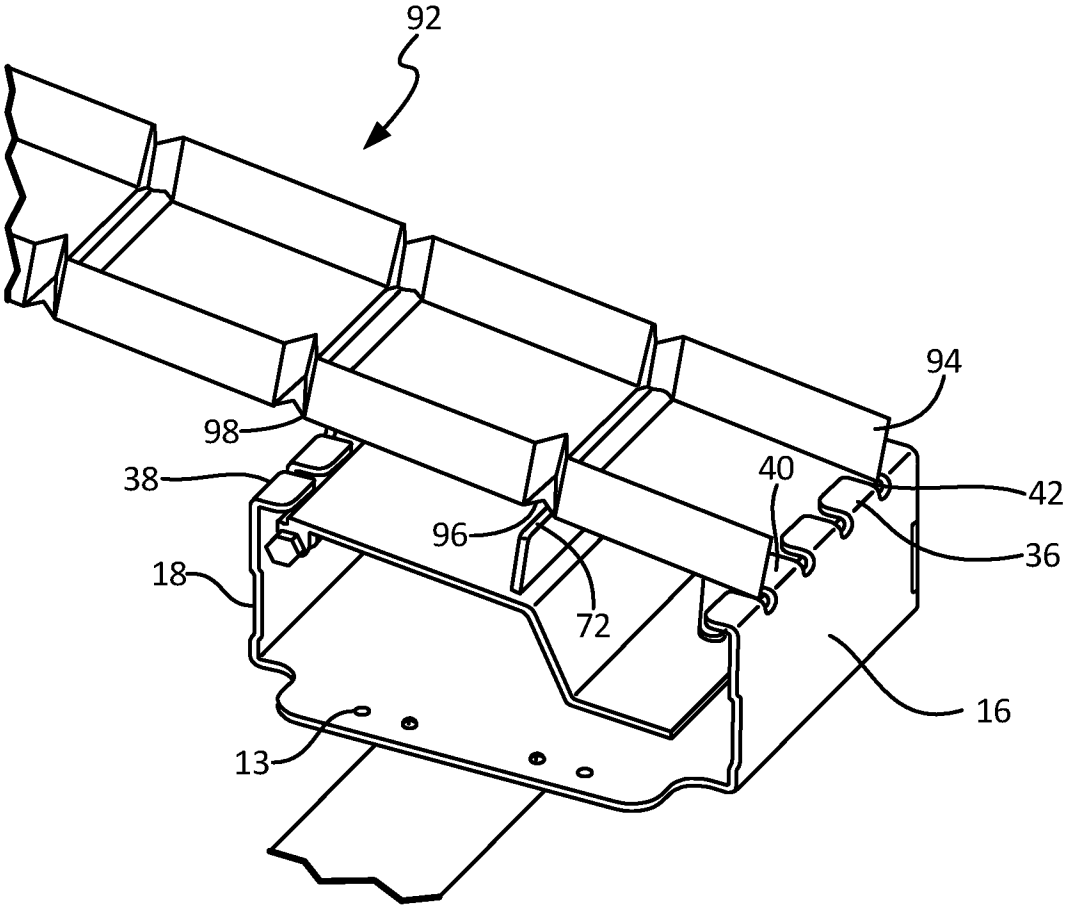
FIG. 6 is a perspective view of the apparatus of the present invention with a workpiece being shaped.
Figure 7:
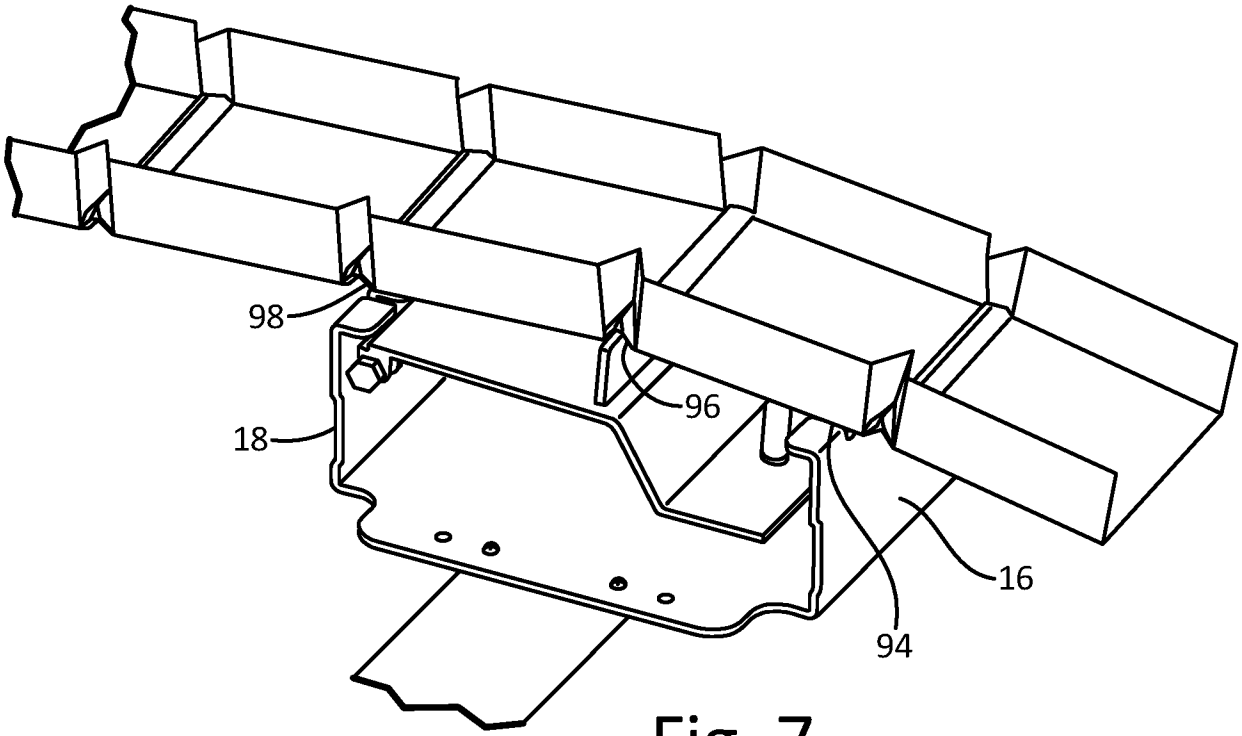
FIG. 7 is a perspective view of the apparatus of the present invention with a workpiece being shaped.
Figure 8:
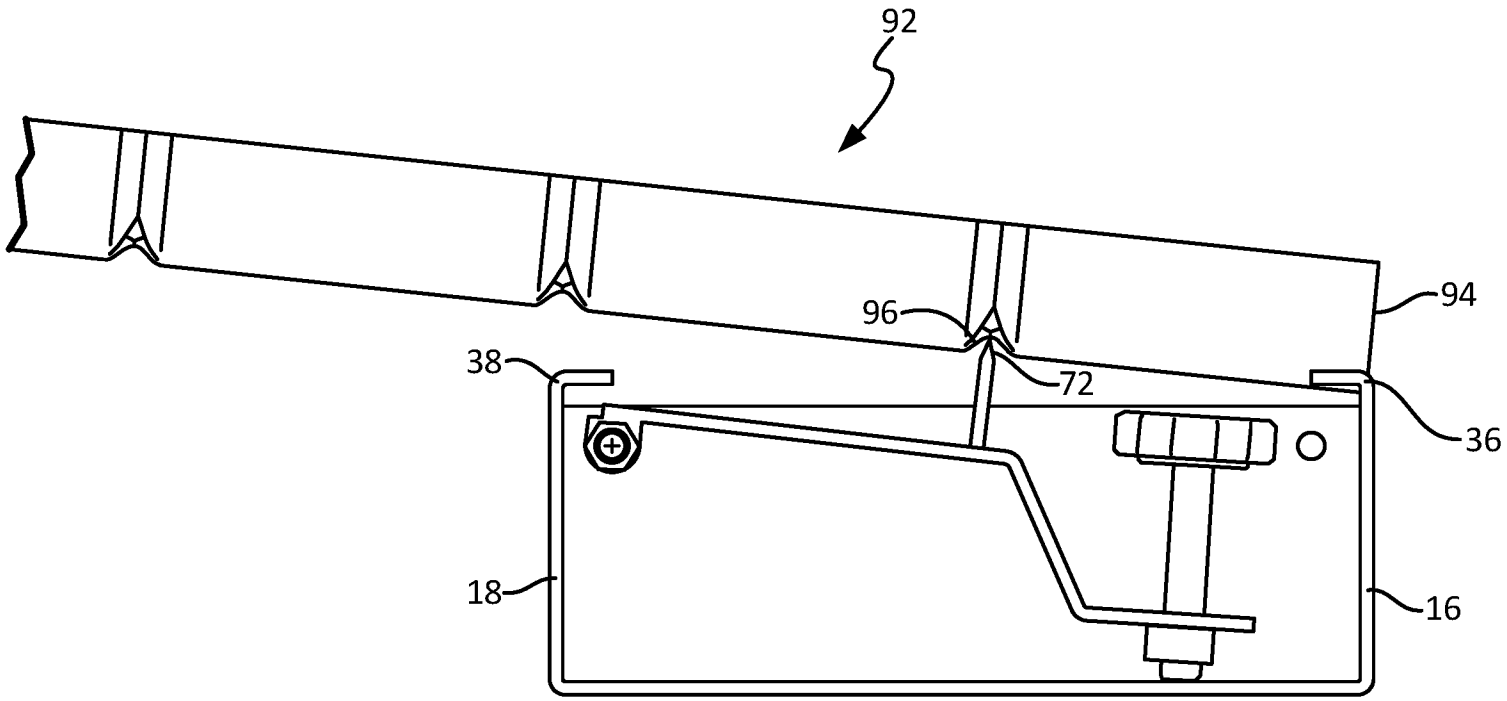
FIG. 8 is a side elevational view of the apparatus of the present invention with a workpiece being shaped.
Figure 9:
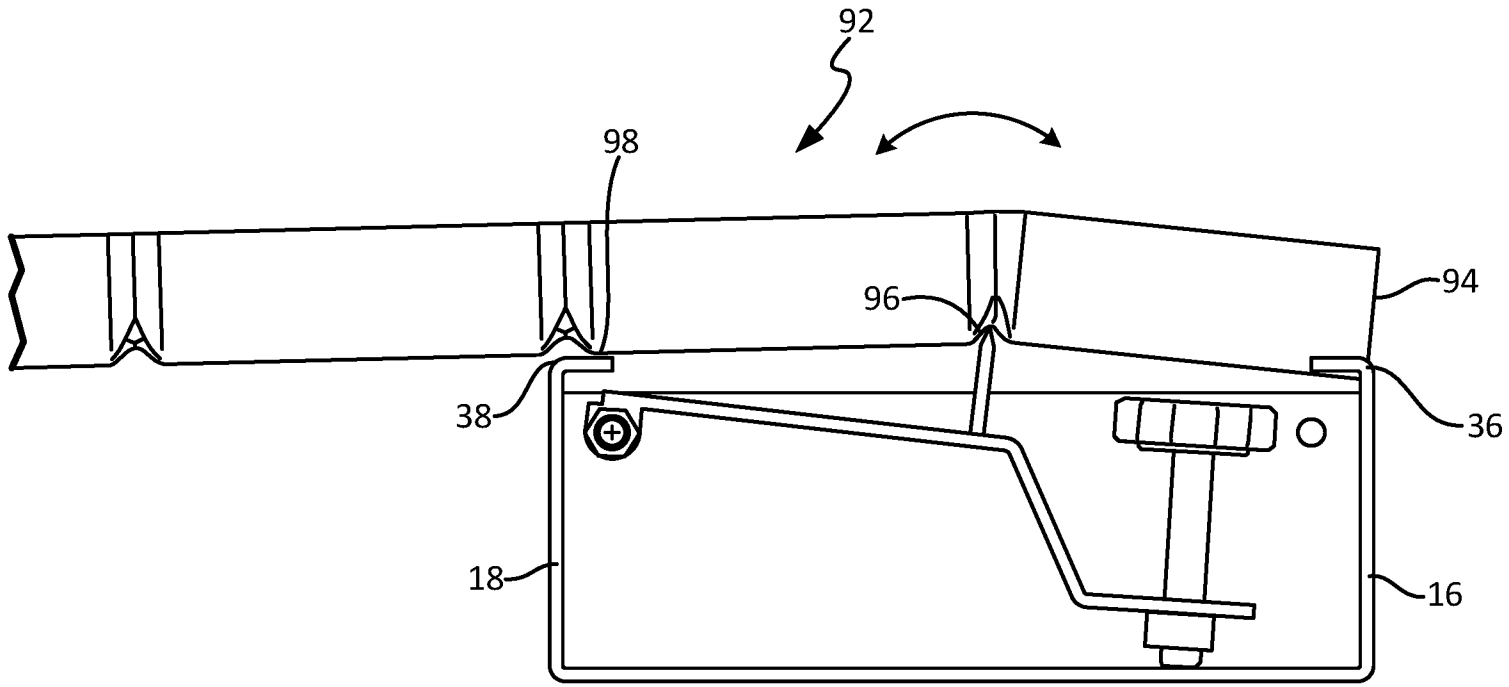
FIG. 9 is a side elevational view of the apparatus of the present invention with a workpiece being shaped.
Figure 10:
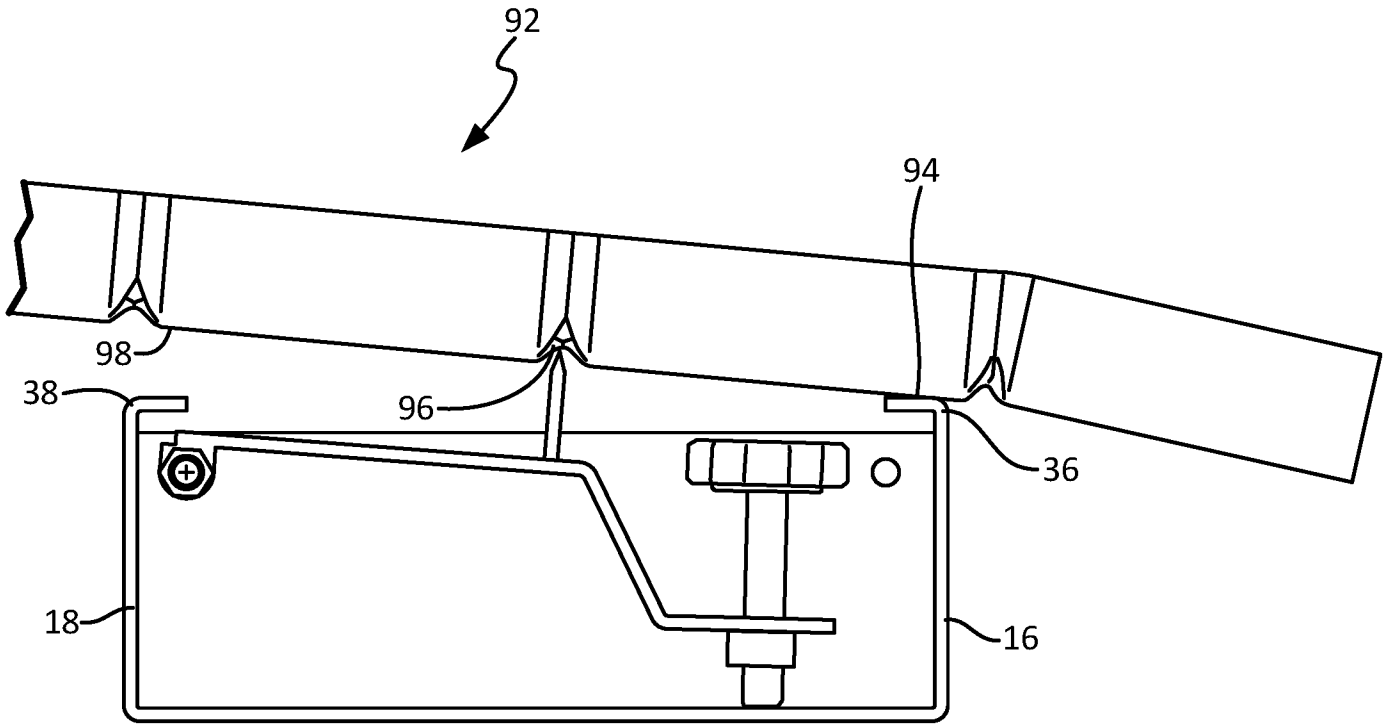
FIG. 10 is a side elevational view of the apparatus of the present invention with a workpiece being shaped.
Figure 11:
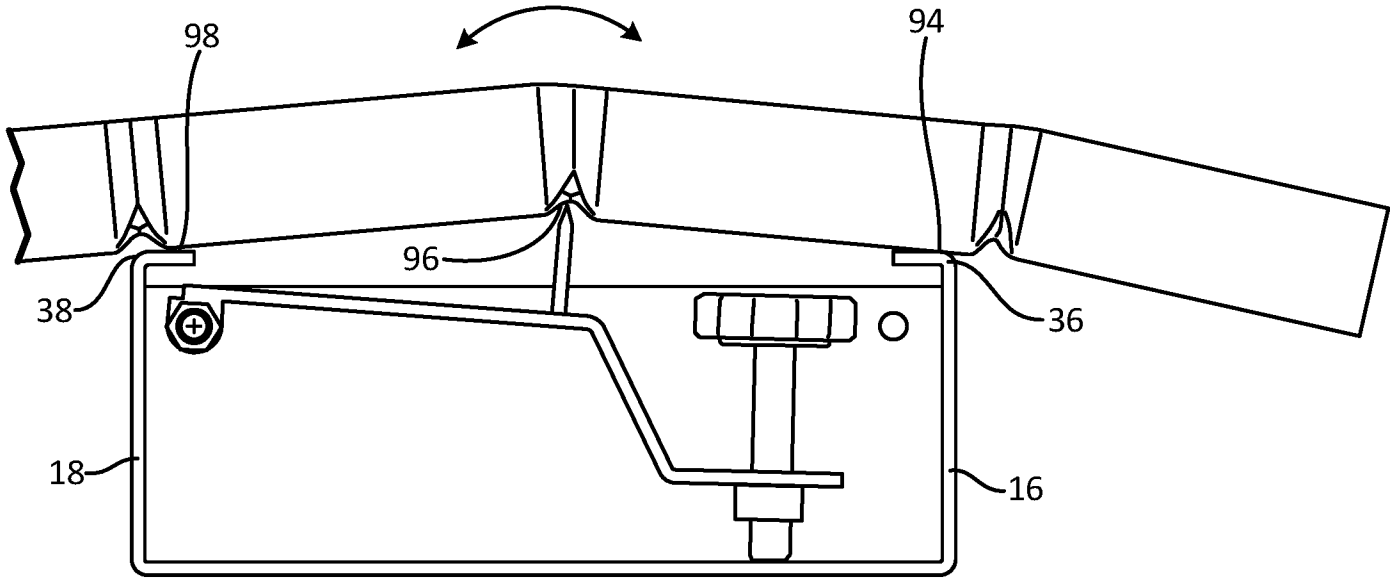
FIG. 11 is a side elevational view of the apparatus of the present invention with a workpiece being shaped.

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Unless otherwise apparent or stated, directional references, such as "upper", "lower", "interior", "exterior", "top", "bottom", "vertical", "horizontal", "upward", "downward", and the like are intended to be relative to the orientation of a particular embodiment of the invention as shown in the figures. In addition, a given reference numeral in the drawings indicates the same or similar structure when it appears in different figures and like reference numerals identify similar structural elements and/or features of the subject invention.

With reference now to the drawing figures, and first to FIG. 1, tool 10 includes a housing or frame 12 with a base 14 and first and second walls 16, 18 connected to the base 14. Base 14 may have a perimeter 20 defining at least a first side 22 and a second side 24, wherein first wall 16 may extend upwardly from first side 22 of perimeter 20, and second wall 18 may extend upwardly from second side 24 of perimeter 20. It is contemplated, however, that at least one of first and second walls 16, 18 may be connected to one or more portions of base 14 other than, or excluding perimeter 20. In the illustrated embodiment, first and second walls 16, 18 extend from respective first and second sides 22, 24 of perimeter 20, and define a length "L" along a first direction 26 between first and second walls 16, 18. In typical embodiments, length "L" in the range of between about 4-30 inches, though it is contemplated that such dimensional range may be expanded to accommodate various applications for tool 10.

In the illustrated embodiment, housing or frame 12 includes third and fourth walls 28, 30 connected to base 14, first wall 16, and second wall 18 to form a partial enclosure 32. One or more of walls 16, 18, 28, 30 may be integrally formed with and extend directly from base 14, or may instead be connected directly or indirectly to base 14 through fasteners, adhesives, and the like. The components of frame 12 may be fabricated from any suitable material, though various metal materials are contemplated as being most likely employed in the manufacture of frame 12, with particular examples including aluminum, nickel steel, galvanized steel, stainless steel, and other relatively strong and durable metal materials.

Base 14 includes an upper surface 15 such that, for the purposes hereof, the term "upward" or "upwardly" shall mean generally along direction 34.

First wall 16 may extend upwardly from base 14, and may terminate at a first end 36 to define a first height "$h_1$" with respect to base 14. Second wall 18 may extend generally upwardly along direction 34 from base 14, and may terminate at a second end 38 to define a second height "$h_2$" with respect to base 14. In some embodiments, first and second heights $h_1$, $h_2$ may be substantially equal. In other embodiments, however, such first and second heights $h_1$, $h_2$ may be inequal. In typical embodiments, first and second heights $h_1$, $h_2$ may be in the range of between about 1-10 inches, though it is contemplated that such dimensional range may be expanded to accommodate various applications for tool 10.

In the illustrated embodiment, first and second walls 16, 18 are substantially parallel to one another, though it is contemplated that such first and second walls 16, 18 may be skew with respect to one another.

In some embodiments, a plurality of spaced apart projections 40 may be connected to at least one of first and second ends 36, 38 of the respective first and second walls 16, 18. Such spaced apart projections may extend at an angle that is less than 180° from a respective one of the first and second ends 36, 38, and, as shown in the illustrated embodiment, toward the other of the first and second ends 36, 38. In some cases, projections 40 extend at an approximately 90° angle with respect to the associated one of the first and second walls 16, 18 toward the other of the first and second walls 16, 18. Such an arrangement is illustrated in the drawings.

As will be described further hereinbelow, projections 40, and particularly gaps 42 between adjacent projections may be arranged to receive portions of the wall and ceiling framing members shaped through the use of tool 10. One or more portions of a wall or ceiling framing member, for example, may be received in one or more gaps 42 between adjacent projections 40 so that an adjacent portion of such wall or ceiling framing member may bear against the surface of projection 40 to hold the wall or ceiling framing member in place during a shaping process. Projections 40 may be provided in one or more of a variety of configurations, and therefore define gaps 42 of various configuration.

In the illustrated embodiment, projections 40 may exhibit a parallelepiped body extending from a respective first or second end 36, 28. The projections 40, however, may be somewhat modified in their parallelepiped configuration, with rounded corners and/or edges. As such, applicants' consider the illustrated form of projections 40 to be "substantially parallelepiped".

Tool 10 preferably further includes a plate 50 that is connected to the housing or frame 12 and positioned between first and second walls 16, 18. In the illustrated embodiment, plate 50 is pivotally secured to frame 12 about a pivot axis 52, which may be defined by a shaft 54 connected to third and fourth walls 28, 30. Plate 50 may include one or more sockets 56 with a receptacle 58 for receiving shaft 54 along pivot axis 52. Sockets 56 may be integrally formed with, or connected to plate 50. In the illustrated embodiment, plate 50 has a lower surface 60 facing base 14, and an opposed upper surface 62.

An adjustment mechanism 64 is provided for selectively adjusting the position of plate 50 with respect to base 14. In the illustrated embodiment, adjustment member 64 may be engaged with plate 50, and arranged to adjust a pivot orientation of plate 50 about pivot axis 52. It is contemplated that adjustment mechanism 64 may selectively adjust the position of plate 50 in a variety of ways, though it may be advantageous to provide adjustment mechanism 64 with the ability to make minor adjustments to the position and/or orientation of plate 50.

In the illustrated embodiment, adjustment mechanism 64 is threadably adjustable, in that rotation of a threaded shaft 66 with a fixed threaded engagement alters the position of plate 50 with respect to base 14. Threaded shaft 66 may be threadably engaged with an engagement portion 68 that is fixedly connected to plate 50, so that rotation of threaded shaft 66 with respect to engagement portion 68 results in axial movement of plate 50 along shaft 66. Base 14 may provide a bearing surface against which threaded shaft 66 may contact to support and adjust the position of plate 50. A handle 70 may be provided to assist in the rotation of threaded shaft 66, wherein handle 70 is connected to threaded shaft 66.

An edge 72 is repositionable with plate 50 to a location wherein a first plane 74 connecting first and second ends 36, 38 of first and second walls 16, 18 is between edge 72 and base 14. Edge 72 may be movable with plate 50 and oriented substantially transverse to first direction 26 within length "L". For the purposes hereof, to be "within length L" means between respective wall planes 80, 82 that are perpendicular to base 14 and tangential to respective first and second ends 36, 38. For the purposes hereof, the term "edge" means a narrow portion at or adjacent to the beginning or end of an object or object feature. The object may be a blade 76, as illustrated in the drawings. In other embodiments, edge 72 may be formed from plate 50, as the narrowed end of a feature formed into plate 50. In the illustrated embodiment, blade 76 may be connected to plate 50, and may extend in an upward direction with respect to upper surface 62 of plate 50. Blade 76 may be variously shaped as a protrusion from or connected to plate 50.

Tool 10 may be used alone or in connection with a platform 90, wherein tool 10 may be secured to platform 90 through a variety of means, including fasteners extending through apertures 13 in base 14. As shown in FIGS. 5-11, a wall or ceiling framing member 92, which may be referred to herein as a "workpiece" may be shaped by bending the workpiece 92 about edge 72. The relative adjustable position of edge 72 with respect to first plane 74 may determine the extent of bending or curving applied to the workpiece. So that the shaping may be performed to a consistent and predictable extent, a first portion 94 of workpiece 92 may be placed at first end 36 of first wall 16, and a second portion 96 of workpiece 92 placed at edge 72. When so positioned, the workpiece is bent about edge 72 to impart a desired shaping to workpiece 92.

Edge 72 preferably represents a fulcrum about which the workpiece may be shaped to a desired extent, with such extent determined by a combination of length "L" and the relationship between the fulcrum and first plane 74. Consistent and accurate shaping of the workpiece may be enabled by bending the workpiece about the fulcrum until a third portion 98 of workpiece 92 contacts second end 38 of second wall 18. Thus, where both the length "L" and a fulcrum height "F" above first plane 74 are known, the radius of curvature applied to such workpiece 92 may be calculated.

Workpiece 92 may preferably be fabricated from a material that may be permanently deformed with an applied physical stress without breaking. Therefore, workpiece 92 may preferably exhibit sufficient plasticity, ductility, and malleability to be modified in its configuration through the process described herein without either breaking or substantially rebounding toward its original configuration. Most commonly, workpiece 92 may be fabricated from a relatively light-gauge steel, such as between 16-22 gauge sheet steel. Contacting third portion 98 of workpiece 92 to second end 38 may therefore preferably permanently alter the configuration of workpiece 92 to a desired shape. Adjusting the position of the fulcrum with adjustment mechanism 64 may set edge 72 into a predetermined location with respect to first and second ends 36, 38 and first plane 74. Such relative location of the fulcrum provides the accurate extent of shaping to workpiece 92.

Depending upon the configuration for workpiece 92, first portion 94 of workpiece 92 may be engaged with one or more of projections 40 by receiving first portion 94 of workpiece 92 into one or more of gaps 42. When so engaged, application of a force to workpiece 92 to bend workpiece 92 about the fulcrum represented by edge 72 causes first portion 94 to be restrained by one or more of projections 40. Such restraint aids in securing workpiece 92 to at least first end 36 of tool 10 during the shaping process. First portion 94 of workpiece 92 need not be an end of workpiece 92. Instead, second portion 96 is merely between first portion 94 and third portion 98.

Workpiece 92 may be "pre-creased" by having crimps or creases placed in one or more portions thereof. In some embodiments, such creases may align with the fulcrum of edge 72 during the shaping process, so that edge 72 may nest into the crease to support workpiece 92 in the shaping process. In other embodiments, however, it is contemplated that workpiece 92 may not have crimps or creases, and that the fulcrum may not contact workpiece 92 at a pre-formed crimp or crease.

The invention has been described herein in considerable detail in order to comply with the patent statutes, and to provide this skilled in the art with the information needed to apply the novel principles and to construct and use embodiments of the invention as required. However, it is to be understood that the invention can be carried out by different methods/devices, and that various modifications can be accomplished without departing from the scope of the invention itself.

What is claimed is:

1. A tool for shaping wall and ceiling framing members, the tool comprising:

a frame having a base and first and second walls connected to the base defining a length along a first direction between the first and second walls, the first wall terminating at a first end to define a first height with respect to the base, and the second wall terminating at a second end to define a second height with respect to the base;

a plate positioned between the first and second walls pivotally secured to the frame about a pivot axis, the plate having a lower surface facing the base, and an opposed upper surface;

an edge movable with the plate oriented substantially transverse to the first direction within the length; and an adjustment member engaged with the plate arranged to adjust a pivot orientation of the plate about the pivot axis, wherein at least a portion of the edge is positionable above a first plane between the first and second ends of the first and second walls.

2. The tool of claim 1 wherein the first and second walls are substantially parallel to one another.

3. The tool of claim 2 wherein the first and second heights are substantially equal.

4. The tool of claim 1, including a plurality of spaced apart projections extending from at least one of the first and second ends.

5. The tool of claim 4 wherein the projections extend at an angle less than 180° from a respective one of the first and second ends toward the other of the first and second ends.

6. The tool of claim 1 wherein the edge is repositionable with the plate.

7. The tool of claim 1 wherein the edge is a narrow portion of a blade that extends from the upper surface of the plate.

8. The tool of claim 7 wherein the blade terminates in the edge.

9. The tool of claim 1 wherein the adjustment member is threadably adjustable.

10. The tool of claim 9 wherein the adjustment member includes a shaft that is threadably engaged with an engagement portion and contactable with the base, and a handle connected to the shaft.

11. A method for shaping a wall or ceiling framing member with the tool of claim 1, said method comprising the steps of:

(a) placing a first portion of the wall or ceiling framing member at the first end of the first wall;

(b) placing a second portion of the wall or ceiling framing member at the edge; and (c) bending the wall or ceiling framing member about the edge.

12. The method of claim 11, including bending the wall or ceiling framing member about the edge until a third portion of the wall or ceiling framing member contacts the second end of said second wall.

13. The method of claim 12 wherein the second portion of the wall or ceiling framing member is between the first and third portions of the wall or ceiling framing member.

14. The method of claim 13, including engaging the first portion of the wall or ceiling framing member with one or more of projections which extend at an angle less than 180° from a respective one of the first and second ends toward the other of the first and second ends by receiving the first portion of the wall or ceiling framing member into a slot between adjacent ones of the projections.

15. The method of claim 12, including, prior to step (c), adjusting the pivot orientation of the plate about the pivot axis to position the edge into a predetermined location with respect to at least one of the first and second walls, wherein the predetermined location defines the extent of shaping performed by bending the wall or ceiling framing member about the edge until a third portion of the wall or ceiling framing member contacts the second end of said second wall.

16. The method of claim 11 wherein step (c) creates a crease in the wall or ceiling framing member.

17. The method of claim 11, including, prior to step (a), securing the base to a platform.

18. A tool for shaping wall and ceiling framing members, the tool comprising:

a housing having a base with a perimeter defining first and second sides, a first wall extending upwardly from the first side, and terminating at a first end to define a first height with respect to the base, and a second wall extending upwardly from the second side and terminating at a second end to define a second height with respect to the base;

a plate connected to the housing and positioned between the first and second walls;

an adjustment mechanism for selectively adjusting a position of the plate with respect to the base; and a fulcrum that is repositionable with the plate to a location wherein a plane between the first and second ends of the first and second walls is located between the fulcrum and the base.

19. The tool of claim 18 wherein the first and second walls are substantially parallel to one another.

20. The tool of claim 19 wherein the first and second heights are substantially equal.

21. The tool of claim 18, including a plurality of spaced apart projections extending from at least one of the first and second ends.

22. The tool of claim 21 wherein the projections extend at an angle less than 180° from a respective one of the first and second ends toward the other of the first and second ends.

23. The tool of claim 18 wherein the fulcrum is formed from the plate.

* * * * *